United States Patent [19]

Hall, Jr.

[11] 4,443,793

[45] Apr. 17, 1984

[54] GAS DETECTION SYSTEM

[75] Inventor: Norman M. Hall, Jr., El Paso, Tex.

[73] Assignee: Calnor of El Paso, El Paso, Tex.

[21] Appl. No.: 317,444

[22] Filed: Nov. 2, 1981

[51] Int. Cl.[3] ..... G08B 17/10

[52] U.S. Cl. ..... 340/634; 73/23; 422/96

[58] Field of Search ..... 340/634; 422/96, 98; 73/23, 27

[56] References Cited

U.S. PATENT DOCUMENTS

| | | | |
|---|---|---|---|
| 3,635,282 | 1/1972 | Watanabe | 340/6.34 X |
| 3,882,478 | 5/1975 | Skarman | 340/6.34 X |
| 3,930,247 | 12/1975 | Hurd | 340/6.34 X |
| 4,007,456 | 2/1977 | Paige et al. | 340/6.34 X |
| 4,112,356 | 9/1978 | Toy | 340/6.34 X |
| 4,177,668 | 12/1979 | Holmberg | 340/6.34 X |
| 4,345,242 | 8/1982 | Ienna-Ballistreri | 340/6.34 |

*Primary Examiner*—John W. Caldwell, Sr.
*Assistant Examiner*—Daniel Myer
*Attorney, Agent, or Firm*—James F. Duffy

[57] ABSTRACT

Improvements in a gas detecting system utilizing a filament-heated gas sensor displaying measurable resistance characteristics which vary with the concentration of selected gases within the atmosphere in the vicinity of the sensor inhibit the production of gas detection indications automatically during the initial activation of the system while the sensor element is stabilizing and further inhibit the production of short staccato alarm indications produced by inherent small changes in the characteristics of the sensor brought about by thermal drift.

10 Claims, 4 Drawing Figures

GAS DETECTION SYSTEM

BACKGROUND

1. Field of the Invention

The invention relates to gas detection systems utilizing non-radioactive detectors.

In particular, the invention relates to gas detection systems utilizing a gas sensor whose elements are exposed to the atmosphere such that the resistance between such elements varies with the concentration of selected gases contained within the atmosphere.

Specifically, the invention relates to gas detection systems utilizing a variable resistance gas sensor having detection elements which are heated to proper operating temperatures and which sensor inherently provides false alarm indications when first activated and is further susceptible to staccato false alarm indications due to slight inherent drift operating characteristics in the course of its utilization, the invention providing the means for inhibiting such false indications of gas detection.

2. Prior Art

On July 4, 1922, U.S. Pat. No. 1,421,720 was issued to Roberts for his method of and apparatus for detecting the presence of one gas in another. Roberts utilized a gas sensor containing a pair of electrodes, at least one of which was heated. The electrodes were exposed to the atmosphere and current passing from one electrode to another was dependent upon the amount of gas to be detected contained within the atmosphere impinging upon the electrodes.

An ozone gas detector invented by Webster et al was disclosed in U.S. Pat. No. 3,778,229, issued Dec. 11, 1973. Webster et al provided a tubular substrate of high electrical resistivity and coated this substrate with a metal oxide whose resistance increased significantly with increasing ozone concentration in the atmosphere. Electrodes were provided as means for measuring the varying electrical resistivity of the oxide coating. An electrically heated filament was utilized to raise the oxide coating to the operating temperature to produce a significant change in the electrical resistance of the metallic oxide coating in response to variations in ozone concentration in the atmosphere.

Typical of the sensors employed by Roberts and Webster et al was the fact that a non-stable gas sensing element was provided while the sensor was brought to its effective operating temperature.

Apparatus for determining the alcoholic content in the blood as a result of sampling a person's breath utilizing a variable resistance gas sensor of the type manufactured by Figaro Manufacturing Company, Osaka, Japan is disclosed in U.S. Pat. No. 4,177,668 to Holmberg, issued Dec. 11, 1979. A Figaro TGS 812 gas sensor provides one element of a Wheatstone bridge. When the system is activated and the sensor is brought to operating temperature, the bridge is balanced by means of a potentiometer. The presence of gas, detected by the gas sensor, results in an unbalance in the bridge which is, in turn, detected by a voltage comparator which controls an alarm which is activated upon the detection of gas in the atmosphere. Because of the inherent instability of the Figaro gas sensor as it is brought up to operating temperature, Holmberg provides a manually operated circuit to prevent full activation of the system until the sensor has reached operating temperature. This circuit inhibits the production of false alarms while the sensor is brought to operating temperature and stabilized. Full activation of the system is thereafter achieved by manual closing of a switch following the illumination of a ready light indicating that the apparatus is ready to be used and the sensor has reached its operating temperature.

It is seen that gas detection systems utilizing thermally heated gas sensors are well known in the prior art and that all such systems are unstable immediately after activation and remain unstable until the temperature of the gas sensor has been raised and established at its operating point. Those skilled in the art of thermal sensitive devices will be aware of the inherent small drifting variation in performance characteristics of such devices provoked by thermal drift about their selected operating temperature. Such inherent initial unstability of the gas sensor requires that full implementation of a gas detection system utilizing such sensors be delayed until the gas sensor has stabilized at its operating temperature. In the gas detection systems of which the inventor has knowledge such full implementation of the gas detection system is achieved by manual control of the operator after the sensor has stabilized. In systems utilizing voltage comparators to control a sensible alarm, "chattering" of the alarm, that is, short staccato alarm indications, will be produced frequently due to the inherent drift in operating characteristics of the sensor during the period of time the alarm system is activated.

It is an objective of the invention to provide a filament heated, variable resistance gas sensor gas detecting system which avoids the production of false alarms following initial system activation without monitoring or further activity on the part of the operator.

It is a further objective of the invention to provide such a gas detection system which is inherently free of production of staccato false gas detection indications produced by thermal drift performance characteristic changes within the gas sensor.

SUMMARY OF THE INVENTION

The invention represents improvements in gas detection system which comprise a filament heated variable resistance gas sensor in a deliberately unbalanced bridge circuit coupled to a voltage comparator to detect any complementary unbalance created when the sensor detects the presence of a gas. The comparator controls a switching circuit and sensible indicator means so as to provide a sensible indication of the detection of the gas. The improvement comprises first means coupled to the voltage comparator to automatically inhibit the comparators control of the switching circuit and the sensible indicator means. Such inhibition is achieved in this manner automatically without manual control of the operator and is effective while the gas sensor is stabilizing following initial activation of the gas detection system. Inhibiting the comparator during this stabilizing period prevents the generation of false alarm indications of gas detection while the sensor is so stabilizing.

A second means to automatically inhibit the comparator's control of the switching circuit and sensible indicator means is provided to prevent staccato false indications of gas detection due to small inherent drifting changes in the characteristics of the gas sensor in the course of utilizing the gas detection system.

Inhibiting of the voltage comparator during the initial stabilization period following activation of the system is achieved by an RC timing circuit coupled to the voltage comparator to inhibit its operation for a period of time established by the RC time of the RC timing circuit.

The prevention of staccato false alarm indications is achieved by the provision of circuit means coupled to the voltage comparator to provide a window of insensitivity over a selected range of voltages within which selected range of voltages the voltage comparator's operation is inhibited.

Further improvements are achieved by the provision of remote sensible indicator means at locations removed from the immediate vicinity of the gas sensor. Means are provided for activating an exhaust fan upon detection of an undesired gas concentration in the atmosphere in the vicinity of the gas sensor. To provide a record of the variation in gas concentration in the atmosphere surrounding the gas sensor, means are disclosed for coupling a voltage recording device to the gas sensor for recording the variations in the voltage drop across the gas sensor over a selected period of time.

The improvements disclosed further include means for providing an indication of filament burnout within the gas sensor element. In the embodiment disclosed, a light emitting diode is utilized for this purpose.

DETAILED DESCRIPTION OF THE INVENTION

Figaro Manufacturing Company of Osaka, Japan produces gas sensors under a reference designation TGS. These gas sensors are open to the atmosphere, have a heated filament, and display a variable resistance characteristic in the presence of selected gases. Thus, the TGS 812 gas sensor may be utilized to detect carbon monoxide (CO). To detect, for example, propane, the Figaro TGS 813 gas sensor would be employed.

The TGS type gas sensors may be utilized as a resistive element in a voltage divider network and the variation in voltage drop across the sensor element utilized as an indication of the detection of gas. A more sensitive arrangement, and one most frequently seen, utilizes the TGS type sensor as an element in a Wheatstone bridge. The bridge is deliberately unbalanced under normal atmospheric conditions and the presence of a detectable gas in the atmosphere causes the bridge to experience a detected, complementary state of unbalance. This arrangement is illustrated in the schematic of a gas detection system in FIG. 1.

Figure 1:
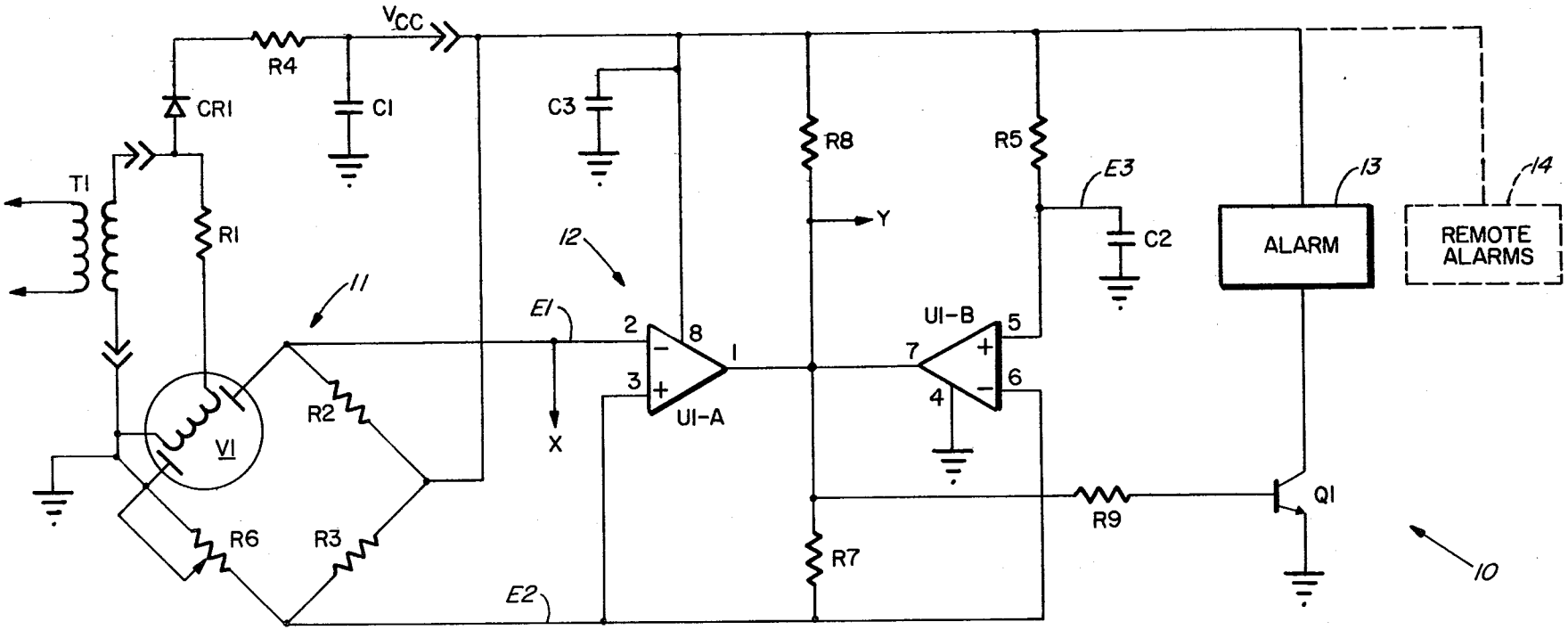
FIG. 1 is a schematic diagram of a gas detecting system provided with the false alarm inhibition improvements disclosed herein.

In FIG. 1, the gas detection system 10 utilizes, for example, a TGS type gas sensor V1 as an element of a Wheatstone bridge 11. As is typical of a Wheatstone bridge, two serial voltage dividers are employed. These voltage dividers comprise resistance R2 and gas sensor V1 as the first of the two voltage dividers and resistances R3 and R6 as the second voltage divider. Resistances R2 and R3 are equal in their resistance values. Resistance 6 is a potentiometer whose resistance value is set manually to establish the sensitivity of gas sensor V1 to detect foreign gases, under normal atmospheric conditions.

Sensor V1 is comprised of semiconductor plates 111 and heater filament 112. The voltage to energize heater filament 112 is derived from transformer T1 through suitable voltage dropping resistor R1. When the filament 112 has been heated to operating temperature, the gas sensor V1 assumes a stable measurable resistance across plates 111 and remains at this measurable resistance value until the atmosphere in the vicinity of gas sensor V1 becomes contaminated with a detectable gas. Upon stabilization of the gas sensor V1, potentiometer R6 may be adjusted to balance the bridge such that the voltage E1 appearing at the junction between resistor R2 and gas sensor V1 and the voltage E2 appearing at the junction between resistances R3 and R6 are equal. Upon detection of a gas in the surrounding atmosphere, the resistance of sensor V1 changes, the bridge becomes unbalanced, and voltages E1 and E2 are no longer equal.

Voltages E1 and E2 are derived by connection of Wheatstone bridge 11 to a source of voltage Vcc at the junction between resistances R2 and R3. The junction between sensor V1 and resistance R6 is connected to a common ground.

Voltage E1 is presented to pin 2 of U1-A of comparator 12. Pin 2 is the inverting input of U1-A. Voltage E2 is presented to pin 3, the non-inverting input of U1-A. When E1 exceeds E2 or when E1 and E2 are equivalent, the output of U1-A, pin 1 remains low. Upon detection of gas contamination on the atmosphere, the resistance of gas sensor V1 will decrease causing a decrease in the amplitude of voltage E1. With E2 exceeding E1 in magnitude, the output of U1-A goes high. This high output at pin 1 of U1-A is presented through resistance R9 to the base of Q1 drawing Q1 into saturated conduction and energizing alarm 13 to provide a sensible indication of gas detection.

Alarm 13 is a sensible indicator which may provide either or both an audible or visual alarm.

Where it is desired to provide a sensible indication of gas detection to an observer at a location remote from gas sensor V1, remote alarms 14 may be employed. Such remote alarms 14 will be activated by the conduction of switching transistor Q1 when pin 1 of U1-A goes high as a result of the unbalance of Wheatstone bridge 11.

To the extent thus far disclosed, any unbalance of Wheatstone bridge 11 will cause a gas detection indication by alarms 13 or 14. When the system is first activated and the filament 112 of gas sensor V1 is bringing plates 111 to their stable operating temperature, an unbalance in Wheatstone bridge 11 will exist. Thus, an alarm indication would normally be given upon activation of system 10. Prior art devices have provided manual means for inhibiting the alarm until such time as gas sensor V1 stabilizes. When such time had elapsed to permit stabilization of sensor V1, the operator of prior art devices manually removed the inhibition of the alarms 13 and 14. The invention provides an improvement to the conventional gas detector system by precluding the necessity of such a secondary manual operation. In accord with the teachings herein, comparator 12 is comprised of dual comparators U1-A and U1-B. The outputs of these comparators, pins 1 and 7 respectively, are coupled together. When the system is first activated, pin 5, the non-inverting input of comparator U1-B, connected to the junction between capacitor C2 and resistance R5 will be low with respect to the voltage E2 which appears at the inverting input, pin 6, of U1-B. This results from the fact that the voltage E3 at the junction between resistance R5 and capacitance C2 is initially at ground potential since no charge exists on capacitor C2. Under these conditions, the output, pin 7, of U1-B, will also be at ground potential. Thus, the output, pin 1 of comparator U1-A, cannot go high and cause switching transistor Q1 to be brought into conduction to activate alarms 13 and 14. This inhibiting of comparator U1-A will continue until voltage E3 reaches the level of Vcc when capacitance C2 is fully charged in a time determined by the RC time constant of the network R5, C2.

The RC time constant of the network R5, C2 is chosen so as to continually inhibit the action of comparator U1-A until such time as gas sensor V1 has reached its operating temperature and stabilized. Thus, no false alarms will be indicated immediately following activation of the gas detector system 10 and no further action is required on the part of the operator to arm the alarm system. Thus, the invention provides an improvement over prior art devices.

Wheatstone bridge 11 will be subjected to small cyclical unbalanced conditions caused by thermal drift within gas sensor V1. Such small cyclical unbalances will cause staccato activation of the alarm system unless a further improvement is provided to avoid such intermittent staccato alarms. To this end, resistor R7 is provided coupling pins 1/7 and 3/6 of comparator 12. The normal voltage at output pins 1/7 is 0.0 volts DC.

Assume that in order to avoid staccato false alarm indications due to thermal drift of sensor V1 a "window of insensitivity" is desired over a range of voltages within which range the action of comparator U1-A is inhibited. By way of example, let this window of insensitivity be a range of 0.100 volts DC from the nominal voltage level at output pins 1/7 of 0.0 volts DC. With an approximate source impedance, R3 and R6, equivalent of 5K ohms and a window of insensitivity of 0.100 volts DC, the current flow will be 20 microamperes.

A nominal value for voltage E2 is 4.35 volts DC. If the value of resistance R7 is taken as 200K ohms, a voltage of 4.25 volts DC results due to the 20 microampere current flow. The result is that the voltage on pins 1 and 3 of U1-A must fall below 4.25 volts DC before the comparator U1-A provides a high output at pin 1 and causes a gas detection alarm indication. When this occurs, the voltage at output pins 1/7 goes to approximately 4.35 volts DC (neglecting base to emitter voltage drop). At this time, current through resistance R7 falls to zero and voltage E2 rises by 0.1 volt DC. The net result of this arrangement is that the voltage E1 can change by almost 0.1 volt DC due to thermal drift affecting the characteristics of sensor V1 before intermittent staccato alarm indications are produced.

The improvements here provided prevent false alarm gas detection indications resulting from initial instability of sensor V1 when the system is first activated or as a result of small inherent thermal drift changes in performance characteristics of sensor V1 while the system is fully activated in an essentially stable state.

An exemplary list of typical components for a gas detector system 10 is given here in Table I

TABLE 1

| Typical Componants | | | |
|---|---|---|---|
| R1: | 3.9–10 ohm (2w, 5%) | C1: | 500 uf, 16 wv |
| R2: | 4.99 K ohm (⅛w, 1%) | C2: | 20 uf, 16 wv |
| R3: | 4.99 K ohm (⅛w, 1%) | C3: | 0.022 uf, 16 wv |
| R4: | 68 ohm (¼w, 5%) | T1: | 115v/50–60Hz-6v |
| R5: | 3M ohm (¼w, 5%) | CR1: | 1N4001 |
| R6: | 100K ohm Pot (¾w, 10%) | LED: | NSL4944 |
| R7: | 200K ohm (¼w, 5%) | Q1: | 2N2222A |
| R8: | 10K ohm (¼w, 5%) | U1: | LM393N |
| R9: | 10K ohm (¼w, 5%) | V1: | FIGARO TGS sensor |
| Relay 16: | OPTO, 10 amp | VR1: | 1N748A |

Tables II and III are here provided to indicate the capabilities of the gas detector system illustrated in FIG. 1. Table II sets forth typical gas concentrations within the atmosphere surrounding sensor V1 required to provide a gas detection indication from alarms 13 and 14. Table III indicates additional gases to which the system 10 of FIG. 1 is sensitive.

TABLE II

| Typical Responses to Toxic Gases | |
|---|---|
| Methane (Most natural gas) | 1000 ppm |
| Iso-butane | 500–600 ppm |
| Propane | 700–800 ppm |
| Hydrogen | 400–500 ppm |
| Carbon monoxide | 1500 ppm |
| Sulphur dioxide | 5–10 ppm |
| Chlorine | Exceeds 50 ppm |
| Ammonia | 500–700 ppm |
| Methyl ethyl ketone | 1000 ppm |
| Freon 22 | 300–400 ppm |
| Gasoline (as a liquid) | 4 micro-liters/liter |

TABLE III

| Partial List of Other Gases | |
|---|---|
| Ethane | Ethylene |
| Methyl Ether | Vinyl Chloride |
| Methyl Chloride | Methylene Chloride |
| Ethylene Oxide | Hydrogen Sulphide |
| Carbon Dioxide | Acetone |
| Methanol | Pentane |
| Hexane | Benzene |
| Ethanol | Methyl Acetate |
| Acrylonitrile | Dimethyl Amine |
| Freon 12 | Freon 11 |

As is apparent, the gas detection system 10 may be utilized to provide combustible-gas alarm indication, indications of carbon monoxide gas within automotive vehicles (battery operation may be provided), smoke alarm indications upon detection of the by-products of incomplete combustion, etc. The system provides the added advantage that no radioactive sensors are required. Thus, disposal presents no environmental problems.

Figure 3:
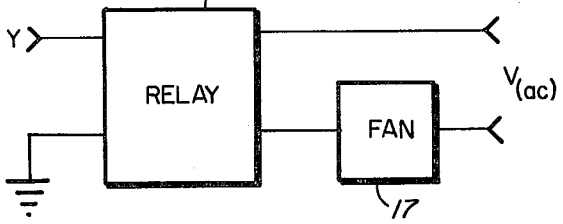
FIG. 3 illustrates the manner in which an exhaust fan may be incorporated into the system of FIG. 1 such that the exhaust fan is actuated upon detection of an undesired gas within the atmosphere to which the gas sensor is exposed.
Figure 2:
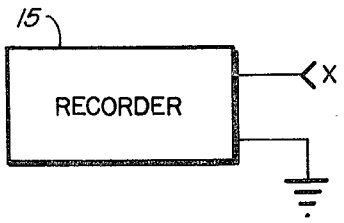
FIG. 2 illustrates the manner in which a voltage recording device may be coupled to the circuit of FIG. 1 to provide a recording of gas levels detected by the system over a selected period of time.

The primary pollutant of the urban atmosphere is sulphur dioxide. The variation of atmospheric pollution levels over a selected period of time, say twenty-four hours, may be measured and preserved utilizing gas sensor V1 and a strip chart recorder 15 as indicated in FIG. 2. An examination of FIG. 1 reveals that the input X to recorder 15 is the voltage indicated as E1 in FIG. 1. This voltage varies with the voltage drop across sensor V1 which in turn is determined by the variation in the level of contamination of the surrounding atmosphere. The comparator 12 and alarm systems 13 and 14 may be utilized in conjunction with recorder 15 to provide a sensible alarm indication of dangerous levels of atmospheric pollution. These latter system elements would not be required if the need determined were only to provide a record of the variation in atmospheric pollution with time.

Where gas detection system 10 if employed to monitor the level or presence of toxic gases in the atmosphere within the vicinity of sensor V1, the system may be modified to control an exhaust fan to rapidly exhaust the atmosphere should a dangerous concentration of toxic gas accumulate. FIG. 3 illustrates the manner in which this result may be achieved. Relay 16, for example a solid state relay, is activated by the voltage Y appearing at output pins 1/7 of comparator 12. When the output of comparator U1-A goes high, pin 1, relay 16 is activated to complete the circuit between a source of voltage Vac and exhaust fan 17. Exhaust fan 17 is thus energized when bridge 11 becomes unbalanced due to the detection of gas by sensor V1.

Figure 4:
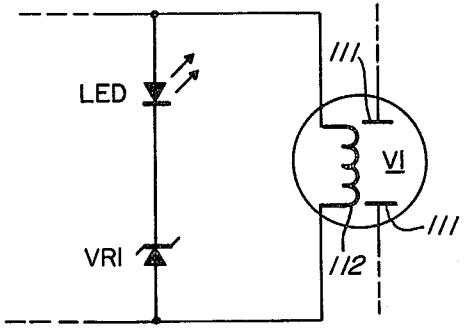
FIG. 4 illustrates the manner in which an indication of filament condition of the gas sensor may be provided to the system operator.

Because proper functioning of system 10 depends upon sensor V1 being heated by filaments 112 to the proper operating temperature, it is advantageous to provide some visual indication of the integrity of filament 112, particularly at the time that Wheatstone bridge 11 is being balanced by adjustment of potentiometer R6. An arrangement to provide such a visual indication is illustrated in FIG. 4. Here, the series combination of a light emitting diode LED and a zener diode VR1 is connected across filament 112 of sensor V1. When filament 112 of V1 is energized, a relatively low current conduction path through filament 112 results and zener diode VR1 will not be drawn into conduction. Should filament 112 fail, however, diode VR1 will avalanche into conduction permitting LED to be drawn into conduction as well. The LED will then provide a visual indication of the failure of filament 112.

Those skilled in the art will recognize that the system 10 may be powered by a variety of power options such as line-level AC voltages, six or twelve volt DC voltages, etc. In addition, line activated systems may be provided with emergency battery power supplied to maintain the system operative should the primary power source fail.

The foregoing description considers the initial balancing of Wheatstone bridge 11 but such practice would prevent establishing a gas sensing threshold of operation of gas detecting system 10 since any small change in resistance between plates 111 of sensor 11 would cause an alarm condition.

The specifications provided by Figaro Engineering Inc. re gas sensor TGS 813 indicate that the resistance of the sensor to uncontaminated air is twice its resistance in air contaminated by 1000 parts per million (ppm) of Methane. Its resistance in air contaminated by 500 ppm of Methane is one and one-half its resistance when exposed to 1000 ppm Methane. Thus to establish the TGS 813 sensor to sensor 1000 ppm Methane in the atmosphere it is desirable that the resistance of sensor V1 in FIG. 1 be able to decrease its resistance to one-half of its value in uncontaminated air before an alarm condition exists.

Voltage comparator U1-A in cooperation with potentiometer R6 of Wheatstone bridge 11 permit establishment of the sensitivity of detector system 10. Since the output of pin 1 of comparator U1-A will remain low so long as E1 exceeds or is equal to E2, potentiometer R6 is initially set to deliberately establish E1 at a magnitude higher than E2, i.e. bridge 11 is deliberately unbalanced.

As gas is introduced into the atmosphere detected by sensor V1, the resistance of the sensor will decrease drawing bridge 11 closer to a balanced state. Potentiometer R6 is adjusted such that bridge 11 passes from one state of unbalance (E1 exceeds E2) to a complementary state of unbalance (E2 exceeds E1) at the desired sensitivity level of gas detection. At that time the output, pin 1, of U1-A will go high and an alarm condition will exist.

It should be stressed that even with this deliberate initial unbalance of bridge 11 a false alarm will be indicated upon energizing detection system 10. This results from the fact that the resistance of sensor V1 is extremely low upon turn-on relative to its stable operating resistance. Sensor V1 experiences an increase of resistance of about eighty-fold as it moves from its initial turn-on status to its operating status. Thus the innovative concepts of the teachings set forth herein are useful in inhibiting such false alarm indications.

The "window of insensitivity" prevents staccato alarm indications due to thermal or long term cyclical drift in sensor characteristics, as well as preventing intermittant alarm indications just below the established threshold sensitivity of the system.

What has been disclosed is a gas detecting system utilizing a filament-heated gas sensor displaying measurable resistance characterstics which vary with the concentration of selected gases within the atmosphere in the vicinity of the sensor. The improvements disclosed inhibit the production of gas detection indications automatically during the initial activation of the system while the sensor element is stabilizing and further inhibit the production of short staccato alarm indications produced by inherent small changes in the characteristics of the sensor brought about by thermal drift.

Those skilled in the art will readily conceive of other embodiments of the invention which may be drawn from the teachings herein. To the extent that such alternate embodiments are so drawn, it is intended that they fall within the ambit of protection provided by the accompanying claims.

Having described my invention in the foregoing specification and drawing in such a clear and concise manner that those skilled in the art may readily understand and practice the invention, That which I claim is:

1. In a gas detection system comprising a gas sensor in a bridge circuit coupled to a voltage comparator to detect an unbalance created when said sensor detects the presence of a gas and a switching circuit and sensible indicator means controlled by said voltage comparator to provide a sensible indication of the detection of a gas, the improvement comprising:

first means coupled to said voltage comparator to automatically inhibit said voltage comparator's control of said switching circuit and sensible indicator means while said gas sensor is stabilizing following initial activation of said gas detection system thereby preventing provision of a false alarm indication of gas detection while said gas sensor is so stabilizing; and second means coupled to said voltage comparator to automatically inhibit said voltage comparator's control of said switching curcuit and sensible indicator means to prevent staccato false indications of gas detection due to later small, cyclical, inherent drifting changes in the characteristics of said gas sensor following sensor stabilization after initial activation.

2. The improvement of claim 1 wherein said first means for inhibiting said voltage comparator's control comprises an RC timing circuit coupled to said voltage comparator to inhibit operation of said comparator for a period established by the RC time of said RC timing circuit.

3. The improvement of claim 1 wherein said second means for inhibiting said voltage comparator's control comprises circuit means coupled to said voltage comparator to provide a window of insensitivity over a selected range of voltages to be compared by said first voltage comparator within which selected range of voltages said first voltage comparator's operation is inhibited.

4. The improvement of claim 1 wherein:

said first means for inhibiting said voltage comparator's control comprises an RC timing circuit coupled to said voltage comparator to inhibit operation of said comparator for a period established by the RC time of said RC timing circuit; and said second means for inhibiting said voltage comparator's control comprises circuit means coupled to said voltage comparator to provide a window of insensitivity over a selected range of voltages to be compared by said first voltage comparator within which selected range of voltages said first voltage comparator's operation is inhibited.

5. The improvement of claim 4 further comprising at least one said sensible indicator means controlled by said voltage comparator at a remote location for providing a sensible indication of gas detection by said gas sensor said sensible indication being provided at a location removed from that of said gas sensor.

6. The improvement of claim 4 wherein said sensible indicator means further comprises an exhaust fan controlled by said voltage comparator and said sensible indication of gas detection comprises activation of said exhaust fan when gas is detected by said gas sensor.

7. The improvement of claim 4 further comprising voltage recording means coupled to said gas sensor for recording variations in voltage across said gas sensor over a selected period of time.

8. The improvement of claim 4 wherein said gas sensor requires a heated filament for proper operation and said improvement further comprises circuit means coupled to said gas sensor for providing a sensible indication of gas sensor filament burnout.

9. The improvement of claim 8 wherein said circuit means for providing a sensible indication of gas sensor filament burnout comprises a light emitting diode.

10. In a gas detection system comprising a gas sensor comprised of a non-evacuated cylinder open to the atmosphere and containing at least two metallic oxide coated plates heated by a filament heater such that in free air a finite resistance is measurable across said oxide coated plates which measurable resistance changes when at least one of a selected gas is introduced into the atmosphere in the vicinity of said cylinder said change in measurable resistance being directly related to the amount of said at least one of a selected gas introduced into said atmosphere, the improvement comprising:

voltage source means coupled across said oxide coated plates of said gas sensor for providing a voltage drop across the measurable resistance across said oxide coated plates;

recording means for recording variations in said voltage drop over a selected period of time;

sensible indicator means coupled to said gas sensor for providing a sensible indication of changes in said measurable resistance in response to gas introduced into the atmosphere in the vicinity of said gas sensor; and circuit means coupled to said sensible indicator means for providing a window of insensitivity over a selected cyclical range of variation of said measured resistance inherently occurring after said gas sensor has been heated by said filament and stabilized within which window operation of said sensible indicator means is inhibited.

* * * * *